United States Patent [19]

Fichte et al.

[11] 4,021,030

[45] May 3, 1977

[54] SHEET FEED METHOD AND APPARATUS

[75] Inventors: Frank Fichte, Taucha; Wolfgang Paul, Leipzig, both of Germany

[73] Assignee: VEB Polygraph Leipzig Kombinat fur Polygraphische Maschinen und Ausrustungen, Leipzig, Germany

[22] Filed: July 2, 1976

[21] Appl. No.: 702,274

[30] Foreign Application Priority Data

July 15, 1975 Germany ..... 6518729

[52] U.S. Cl. ..... 271/11; 271/263; 271/265

[51] Int. Cl.[2] ..... B65H 5/08

[58] Field of Search ... 271/262, 263, 265, 272–274, 271/11; 340/259

[56] References Cited

UNITED STATES PATENTS

| | | | |
|---|---|---|---|
| 3,514,099 | 5/1970 | Miller | 271/273 |
| 3,746,333 | 7/1973 | Capetti | 271/263 |
| 3,826,487 | 7/1974 | Förster | 271/263 |

*Primary Examiner*—Richard A. Schacher
*Attorney, Agent, or Firm*—Michael J. Striker

[57] ABSTRACT

A plurality of rollers each carried on an element pivoted on a support swing back and forth into engagement with respective continuously driven rollers to pinch a sheet delivered between the rollers by means of a vacuum lifter and advance it along a path. A motor on each support can vary the position of the respective movable roller relative to the fixed roller and the pivotal element is insulated from the support but abuts conductively thereagainst in a rest position. A controller connected between the support and the element detects abutment of the two contact surfaces which function as switches and operates a control system that can vary the spacing between each pair of rollers in accordance with the thickness of the sheet being fed to it. A too thick a sheet will push the rollers apart prematurely and open the switch and a too thin sheet will not push them apart before the vacuum lifter releases it. Each time the vacuum lifter releases a sheet a release signal is generated and, shortly commencement of the release signal, a tolerance signal which are fed to a circuit that also receives a signal each time the movable roller is lifted so as automatically to vary the spacing between the rollers.

12 Claims, 5 Drawing Figures

SHEET FEED METHOD AND APPARATUS

BACKGROUND OF THE INVENTION

The present invention relates to a method of and apparatus for feeding a sheet. More particularly, this invention concerns an adjustable feed system for picking the uppermost sheet off a stack and advancing it along a path.

In many printing and copying machines it is necessary to lift the uppermost sheet off a stack of similar sheets and advance it along a path so that a copy can be made on the sheet, it can be printed, or a similar operation can be performed on this single sheet. It is essential in such systems that the sheet arrive at the end of its path at a precisely controlled instant. Therefore, the sheet must at a precisely determined instant start at the upstream end of the path.

The sheet is normally picked off the top of the stack by means of a suction lifter such as described in the commonly assigned patent application 689,857 filed May 25, 1976 by Karl-Heinz Vollrath. Such a suction lifter delivers the sheet after lifting it from the top of the stack to the nip between a pair of rollers. One of these rollers is usually driven continuously and the other roller is moved synchronously with the suction lifter toward and away from the rotating roller. The movable roller moves toward the fixed roller as the sheet is inserted between it so as to press this sheet against the rotating fixed roller and cause it to be advanced along the displacement path for the sheet.

Since in such devices the displacement speed of the lifter is normally not the same as the peripheral speeds of the rollers, it is absolutely essential that the vacuum lifter release the sheet before it is gripped between the rollers. If the vacuum lifter releases the sheet too late, tearing of this sheet can readily result.

Furthermore, if the vacuum lifter releases the sheet too soon, that is before it is properly engaged between the juxtaposed rollers, misalignment of the sheet in the path can readily occur so that any downstream operation performed on the sheet will not be properly centered on the sheet or aligned with the edges of the sheet. It is also possible when the sheet is released too soon that this sheet not even be placed between the rollers so that a misfeed will occur that can readily lead to subsequent jamming-up of the feed apparatus.

For this reason the movable roller is normally provided with some adjustments means that allows its rest position, that it when it is closest to the fixed roller, to be varied. Thus when relatively thick sheets are being transported the movable roller is spaced further away from the fixed roller than when relatively thin or light sheets are being transported. In such an arrangement it is normally necessary to adjust each of the feed rollers, a plurality normally being provided, for each change in workpiece weight. This is a time-consuming and onerous operation. Furthermore, mal-adjustment of even one of the rollers can result in the destruction of the workpiece so that extreme care must be exercised in the adjustment operation.

SUMMARY OF THE INVENTION

It is therefore an object of the present invention to provide an improved workpiece feeding apparatus and a method.

Another object is the provision of improved method of and apparatus for adjusting a sheet feed system.

Another object is to provide a sheet feed apparatus which overcomes the above-given disadvantages.

These objects are attained according to the present invention in a sheet-feed apparatus having a fixed roller rotatable about a fixed axis, a support movable toward and away from this fixed roller and having a contact surface, an element having another contact surface and pivotal on this support between a conducting position with the surfaces abutting and a nonconducting position with the surfaces spaced apart. Means is provided for insulating the contact surface of the element from the support and a movable roller is carried on the element and is engageable with the fixed roller and forming therewith a roller pair that can grip and advance the sheet. Control means is connected to the surfaces for varying the position of the support relative to the fixed roller in dependence on the relative position of the surfaces.

In accordance with this invention the movable roller is urged by a spring toward the fixed roller and in this position the two contact surfaces abut one another and effectively form a switch. The support is formed with a pair of levers and interconnected by a pivot. One of the levers has one end pivotally carrying the element and provided with a contact surface of the support. The control means includes a motor carried on the support and having an output connected to the other ends of the levers. The other lever is carried on a shaft driven by means of a cam so as to oscillate it back and forth and, therefore, move the movable roller toward and away from the fixed roller.

According to another feature of this invention the element is insulated from the support by a dielectric sleeve surrounding the pivot between the element and the support and at least one dielectric washer between the element and the support at the pivot. Thus, the contact surfaces not only serve to define the rest position of the element and support but also act as a switch which opens whenever the movable roller is pushed away from the fixed roller.

In accordance with further features of this invention a pick-up signal is generated each time a sheet is inserted between the rollers, a relatively long release signal is generated each time a sheet is released by the vacuum lifting device, and a relatively short tolerance signal is generated at a predetermined interval after commencement of the release signal but before termination thereof. The spacing between the rollers in a closed position closely juxtaposed wth one another is automatically varied in dependence on the signals. Thus, the spacing between the rollers is increased on simultaneous generation of the release, tolerance and pick-up signals, and the spacing of the rollers is decreased on commencement of generation of the pick-up signal before generation of the release signal. In this manner a completely automatic ajustment of each of the rollers of the sheet feeding system is possible. After changing the weight of the paper fed by the device it is merely possible to turn on the automatic adjustment apparatus and cause a few sheets to be fed by the system. Even though these sheets might be damaged or misfed to a limited extent the system will in at most few feed cycles adjust itself perfectly for the paper thickness. Since each of the rollers adjusts itself independently of the other it is therefore possible to avoid many of the difficulties inherent in the prior-art systems. It is also possible with the system according to this invention to accurately feed a sheet of varying thickness. This is, for instance, the case when envelopes and the like with folded-over portions must be fed.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF THE PREFERRED EMBODIMENT

Figure 1:
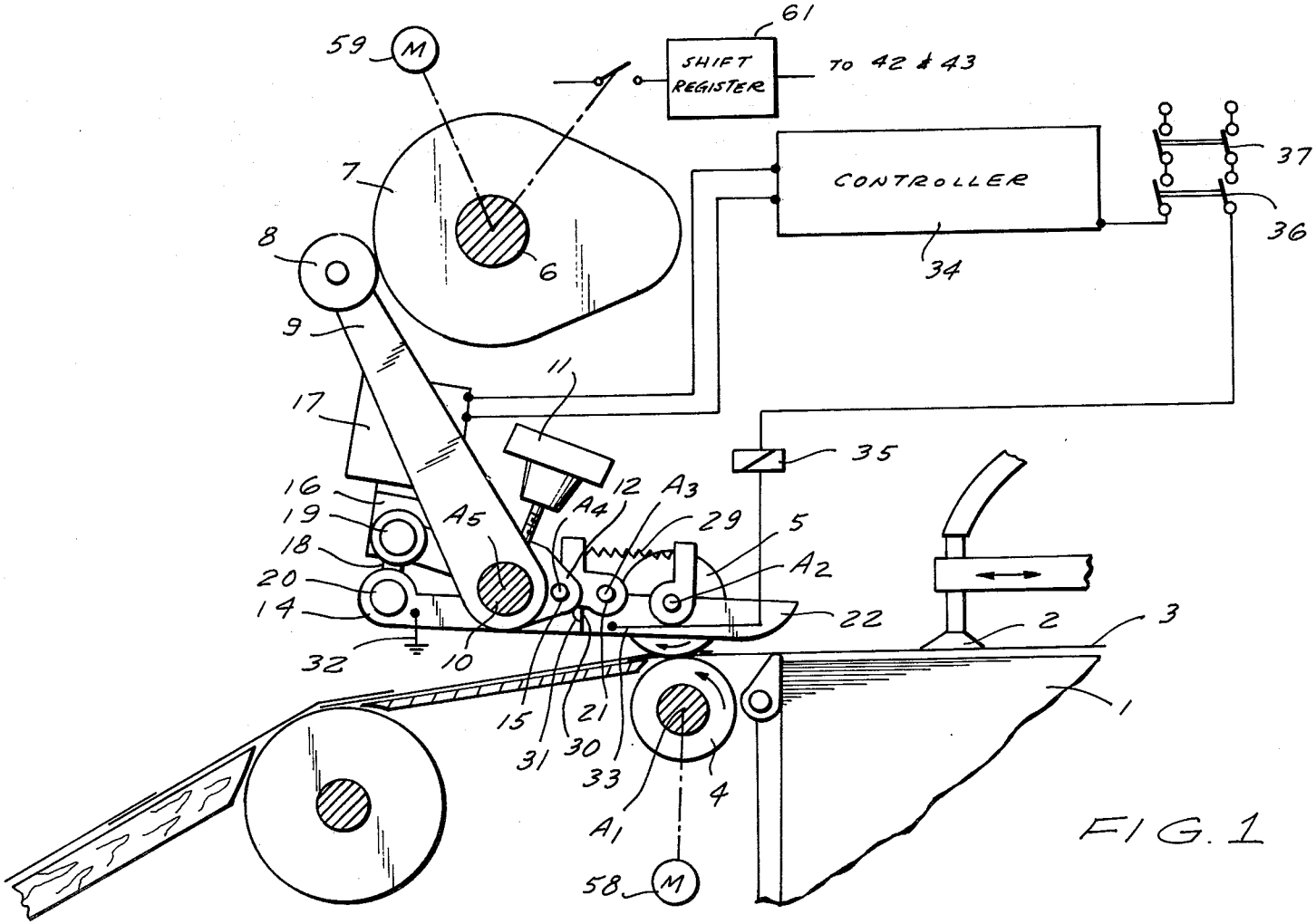
FIG. 1 is a vertical section, partly in diagrammatic form, through the apparatus according to this invention.

As shown in FIG. 1, the upppermost sheet 3 is removed from a vertical stock 1 of such sheets by means of a vertically and horizontally reciprocable vacuum lifting device 2 as described in the above-mentioned copending and commonly assigned patent application. A fixed roller 4 is continuously rotated about a horizontal axis $A_1$ by means of a motor 58 and a movable roller 5 is rotatable on a support element 22 about an axis $A_2$ thereon. This support element 22 is in turn pivoted about an axis $A_3$ on a support formed by a pair of levers 12 and 14. These levers 12 and 14 are in turn together pivoted about an axis $A_5$ defined by a horizontal shaft 10 on which is provided a plurality of such rollers 5 and which has a single arm 9 carrying on one end a roller cam follower 8 that rides on the periphery of the cam 7 carried on a shaft 6 rotated periodically one revolution at a time by a motor 59 and connected to a switch 60 in turn connected to a shift register 61 as will be described below.

Figure 2:
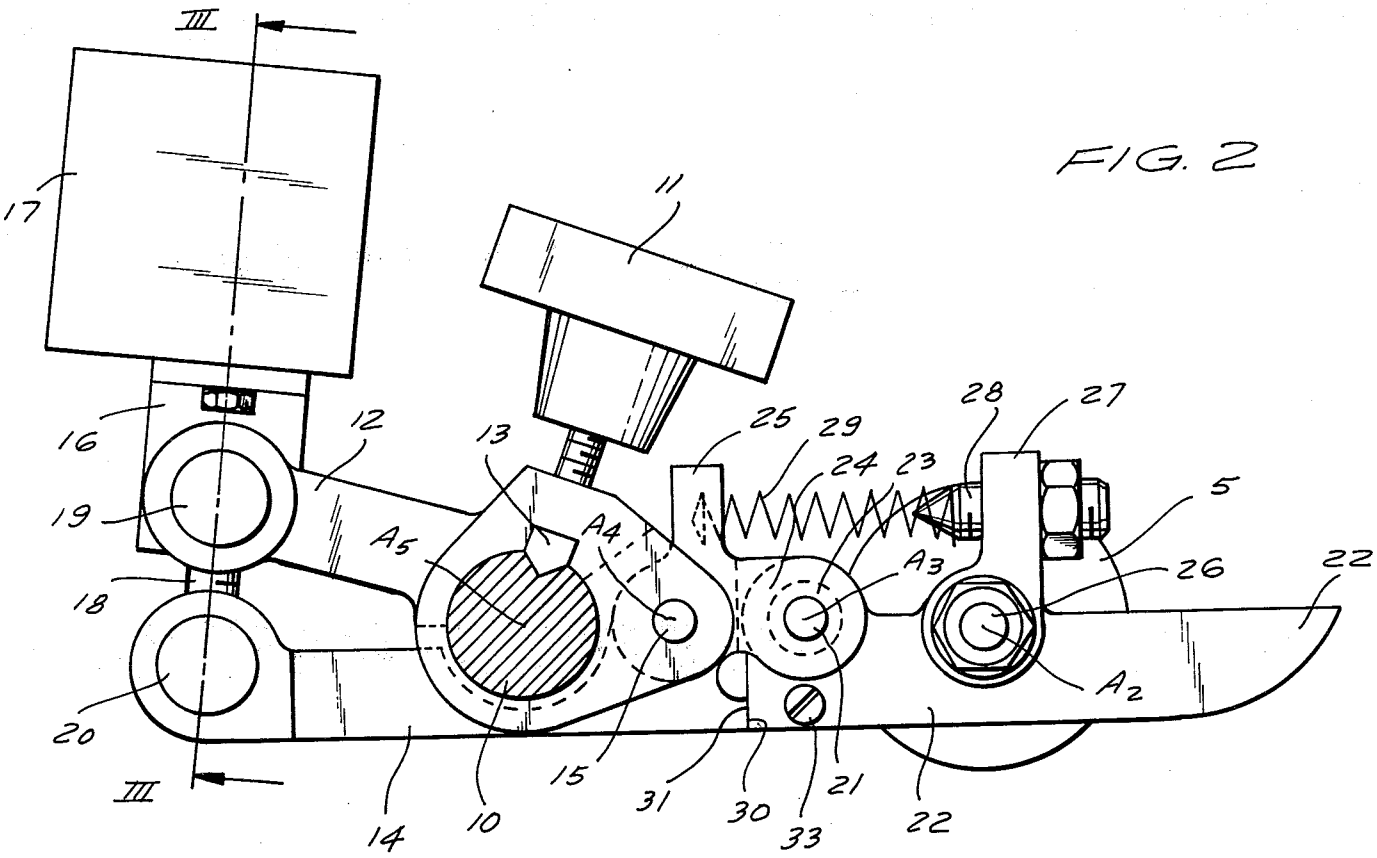
FIG. 2 is a large-scale view of a detail of FIG. 1.
Figure 3:
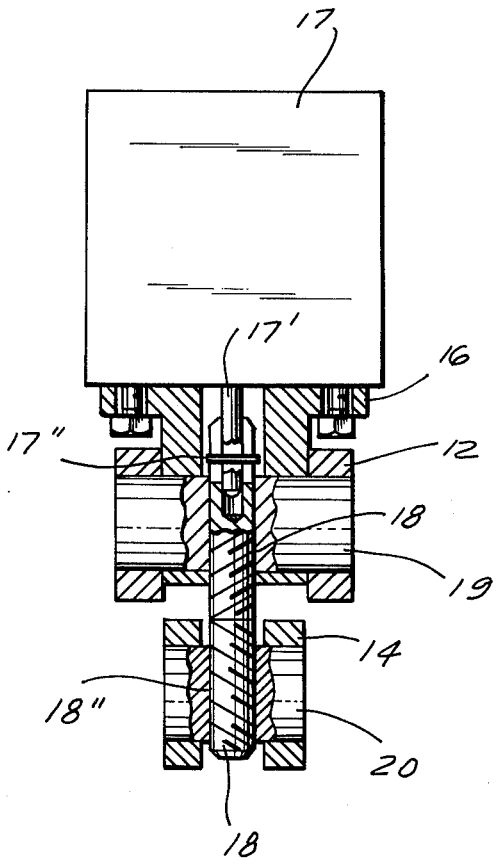
FIG. 3 is a section taken along line III—III of FIG. 2.

As better shown in FIGS. 2 and 3 the lever 12 of the support 12, 14 is slidable along the shaft 10 and rotationally fixed thereon by a key 13. A knob 11 can be rotated to fix this element 12 anywhere along the shaft 10. Carried on the element 12 is a motor 17 secured to a base flange 16 by bolts and having a rotatable shaft 17′ fitted in the end of a screw 18 and rotationally secured thereto by means of a pin 17″. This screw has one end portion 18′ threaded in one direction in a through-going hole in a pin 19 and another end portion 18″ threaded in the opposite direction and threadedly received in a pin 20. The pin 19 is pivoted inside the support lever 12 and the pin 20 inside the support lever 14 so that rotation of the screw 18 in one direction will move the two ends 19 and 20 towards each other and rotation in the opposite direction will move them away from each other. The threads on the screw 18 are of the square power-transmitting type so that even if the motor 17 is not electrically energized forces parallel to the screw 18 will not cause it to rotate in the pins 19 and 20.

The other end of the support lever 12 is provided with a pin 15 constituting the axis $A_4$ about which the support lever 14 is pivotal. This support lever 14 has at its frontmost end a surface 30 which is flat and is adapted to abut against the corresponding surface 31 of the element 22. At its front end the support lever 14 is provided with a pin 21 constituting the axis $A_3$ and forming the pivot for the element 22. A spring 29 engages between a lateral projection or flange 25 of the lever 14 and an insulating screw 28 threaded through a similar lateral projection or flange 27 on the element 22. This spring 29 urges the element 22 into the illustrated position with the surface 30 abutting against and forming electrical contact with the surface 31.

A dielectric sleeve 23 lies between the element 22 and the pivot pin 21 and a pair of insulating or dielectric washers 24 flank this sleeve 23. The roller 5 is formed as a non-driven idler roller and is carried on a pin 26 on the element 22 so as to rotate about the axis $A_2$. All of the axes $A_1$– $A_5$ are parallel.

The shaft 10 is grounded as indicated at 32 and a terminal screw 33 is provided on the element 22 and connected to a relay 35. A controller 34 shown in FIG. 1 is connected to the motor 17 and itself is connected to an on-off switch 37 and an adjust switch 36 as will be described below.

Figure 4:
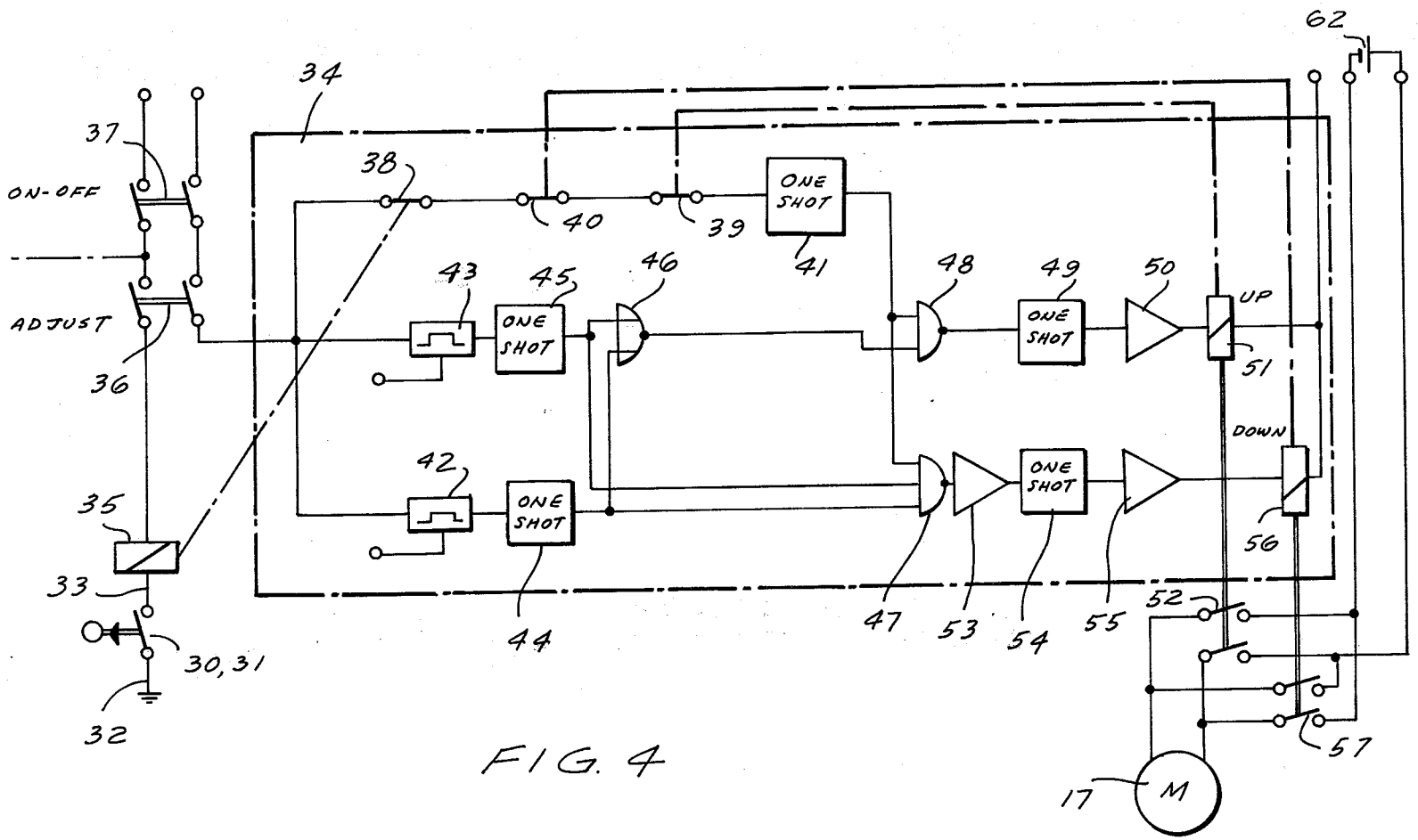
FIG. 4 is a circuit diagram of the controller according to this invention.

As shown in FIG. 4, the two surfaces 30 and 31 form a switch which, when the switches 36 and 37 are closed, can be closed to actuate the relay 35 and open a normally closed contact 38 of this relay. In series between this switch 38 and a mono-stable multivibrator or one-shot 41 are two other switches 39 and 40 which will be described below. In addition, the shift register 61 shown in FIG. 1 is connected to two inputs 42 and 43 connectable through respective one-shots 44 and 45 to a NOR gate 46 whose output in turn is connected to an AND gate 48 having another input connected to the one-shot 41. In addition the one-shot 41 is connected to one input of another AND gate 47 having one input connected to the one-shot 45 and another to the one-shot 44.

The output of the AND gate 48 is connected through another monostable multivibrator 49 and an amplifier 50 to a relay 51 having normally closed terminals 39 and normally open terminals 52 connected between the motor 17 and a power source 62.

The other AND gate 47 is connected through an operational amplifier 53, another monostable multivibrator 54, and another amplifier 55 to a relay 56 having normally closed contacts 40 and other normally open contacts 57 also connected between the motor 17 and the source 62. The contacts 52 and 57 are connected opposite each other so that when the contacts 52 are closed the motor 17 rotates in one direction and when the contacts 57 are closed the motor operates in the opposite direction.

The device shown in FIG. 4 operates as described below with reference to FIG. 5.

The switch 37 forms a part of the overall on-off switch of the sheet feed device and must be closed for the device to operate at all. The switch 36, however, only is closed when the device is to be adjusted. Closure of this switch 36 supplies electrical power to the switch 38, and to the inputs 42 and 43. The shift register 61 generates a pulse at the input 43 which commences the instant the vacuum lifter 2 releases the sheet 3. Thus the switch 60 can be operated either by the shaft 6 which moves synchronously with the lifter 2 or can be operated off the air valve for the lifter 2. Shortly after a signal is generated at 42 a so-called tolerance signal will be generated at 43 which will start slightly later than the signal at 42 but end at the same time. These two signals are seen on lines *c* and *d* of the pulse diagram of FIG. 5.

When the switch 30–31 is closed the relay 35 is actuated and the contacts 38 are opened. Any lifting of the roller 5 will cause the switch 30–31 to open and the relay 35 to become deenergized so that the switch 38 will close. This is shown on line *a* in FIG. 5. As long as the switch 38 closes between the commencement of the release signal at 42 and the commencement of the tolerance signal at 43 as shown in column A of FIG. 5, the motor 17 will not be operated. This is due to the fact that the pulse created by the one-shot 41 as shown at line *b* is shorter than the time period between the commencement of the release signal at 42 and the commencement of the tolerance signal at 43. Thus the one shot 41 will produce a pulse which will be fed to both of the AND gates 48 and 47. During the life of this pulse shown on line *b* the release signal 42 will also coexist so that NOR gate 46 will not produce an output and the AND gate 48 will be blocked. Thus operation of the relay 51 is impossible. At the same time the power signal at 43 has not been commenced so that only two inputs will be applied to the three-input AND gate 47 and this AND gate 47 will also produce no output so that the relay 56 will be similarly unenergized. This operation in column A corresponds to simultaneous insertion of a sheet between the rollers 4 and 5 and release of this sheet by the lifter 2.

Figure 5:
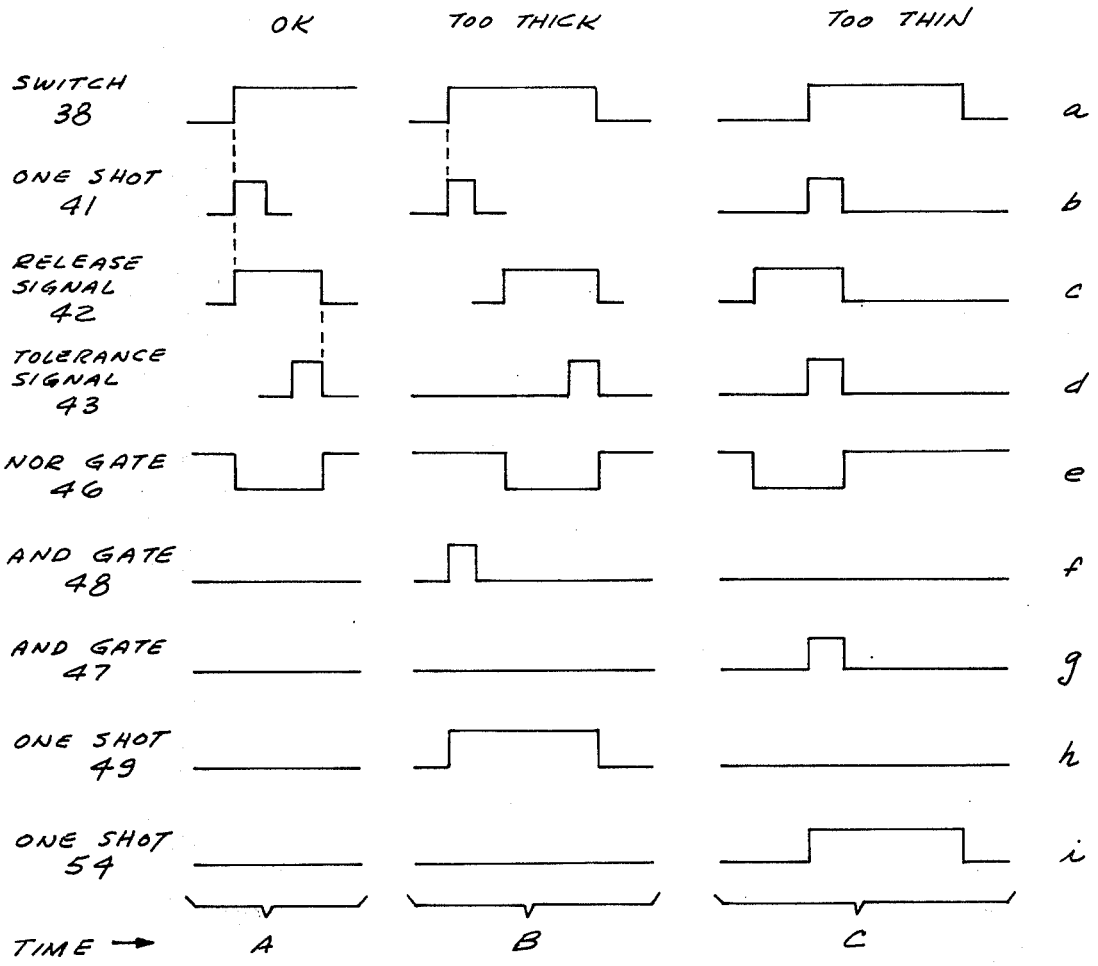
FIG. 5 is a pulse diagram illustrating operation of the circuit of FIG. 4.

In case the sheet inserted between the rollers 4 and 5 is too thick as shown in column B of FIG. 5, the rollers 4 and 5 will be pushed apart before a release signal is created at 42. Since before the one shot 45 operates no inputs are applied to the NOR gate 46 this will apply as shown in line *e* of FIG. 5 a signal to the input of the gate 48 so that as shown in line *f* the AND gate 48 will conduct a pulse to the one shot 49. The output of this one-shot 49 is a relatively long pulse shown on line *h* in FIG. 5 which serves to operate the motor 17 in a direction tending to widen the spaces between the rollers 4 and 5. During such operation of the motor 17 the switch 39 is opened so that the circuit is completely cut off and maladjustment cannot occur during such adjustment.

If as is shown in column C in FIG. 5 a workpiece that is too thin is fed to the rollers 4 and 5 the switch 38 will close substantially after the release signal 42 commences. This closure, which must also be after the commencement of the tolerance signal 43, will therefore cause three inputs to be fed to the gate 47 which will as shown in line *g* feed a pulse to the one-shot 54 as shown at line *i* to operate the motor 17 in the opposite direction, tending to close the gap between the rollers 4 and 5. During such closure again the switch 40 is opened to prevent the system from recycling.

If after any of the above-described operations, whether as shown in column B for a workpiece that is too thick or in column C for a workpiece that is too thin, the system needs adjustment in the same or the opposite direction, it will readjust itself by another increment determined by the length of the pulses created by the one-shots 50 and 55.

In this system the time spacing between a commencement of the release signal at 42 and tolerance signal at 43 determines the tolerance range that is acceptable in the machine. Thus if the sheets are very sensitive it is essential to commence these signals at 42 and 43 practically the same time, but with relatively tough sheets the leading edges of the pulses constituting the signals 42 and 43 can be relatively far apart in order to allow rapid adjustment.

With the system according to the present invention each of the rollers 5 can therefore adjust its position in a fully automatic fashion relatively rapidly. Furthermore, if one of the rollers is properly adjusted but one of the others is out, it is possible for only that roller which is out of adjustment to readjust according to the present invention. The switches 36 of the various controllers 34 can all be ganged and are all normally left open during operation of the machine. Only changing from one workpiece to another requires closing of the switches 36 so that the controllers 34 can readjust their various rollers. This system also readily takes into account varying of the rollers. Indeed with this system one of the rollers can be replaced with a new roller without readjustment of the whole arrangement.

It will be understood that each of the elements described above, or two or more together, may also find a useful application in other types of systems differing from the types described above.

While the invention has been illustrated and described as embodied in a sheet feed system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that from the standpoint of prior art, fairly constitute essential characteristics of the generic or specific aspects of this invention.

What is claimed as new and desired to be protected by Letters Patent is set forth by the appended claims.

1. A sheet feed apparatus comprising: a fixed roller rotatable about a fixed axis; a support movable toward and away from said fixed roller and having a contact surface; an element having a contact surface and pivotal on said support between a conducting position with said surfaces abutting and a nonconducting position with said surfaces spaced apart; means insulating said contact surface of said element from said support; a movable roller carried on said element and engageable with said fixed roller; and control means connected to said surfaces for varying the position of said support relative to said fixed roller in dependence on the relative positions of said surfaces.

2. The apparatus defined in claim 1 wherein said support includes a pair of levers and a pivot interconnecting same, one of said levers having one end pivotally carrying said element and provided with the contact surface of said support, said control means including a motor carried on said support and having an output connected to the other ends of said levers.

3. The apparatus defined in claim 2 wherein said motor has a rotatable output shaft carrying a spindle threadedly engaging said other ends of said levers.

4. The apparatus defined in claim 2, further comprising suction lifting means for picking a sheet off the top of a stack of sheets and inserting an edge of the picked-off sheet between said rollers.

5. The apparatus defined in claim 4 wherein said means for insulating includes a second pivot between said element and said support, a dielectric sleeve surrounding said second pivot, and at least one dielectric washer between said element and said support at said pivot.

6. The apparatus defined in claim 5, further comprising means including a cam and an elongated pivotal shaft provided with a cam follower and carrying a plurality of such supports each associated with a respective movable roller and element for rotatably periodically oscillating said supports in synchronism with the operation of said vacuum lifting means.

7. The apparatus defined in claim 6 wherein the other lever is rotationally fixed on said shaft.

8. The apparatus defined in claim 7, further comprising a spring between said element and said support urging said element into a position with said surfaces pressing against each other.

9. A method of adjusting a sheet feed system comprising the steps of: periodically inserting a sheet with a pickup device between a pair of rollers and substantially simultaneously releasing said sheet from said device; generating a pickup signal each time a sheet is inserted between said rollers; generating a relatively long release signal each time a sheet is released from said device; generating a relatively short tolerance signal at a predetermined interval after commencement of said release signal but before termination thereof; rotating one of said rollers; moving the other roller from a distant position relatively far from said one roller into a close position closely juxtaposed with said one roller shortly before the instant at which a sheet is inserted between said rollers; and automatically varying the spacing between said rollers in said close position in dependence on said signals.

10. The method defined in claim 9 wherein said spacing between said rollers is increased on simultaneous generation of said release, tolerance, and pickup signals.

11. The method defined in claim 10 wherein said spacing between said rollers is decreased on commencement of generation of said pickup signal before generation of said release signal.

12. The method defined in claim 11 wherein said tolerance signal terminates at the same time as said release signal.

* * * * *